US006116661A

United States Patent [19]

Overbey et al.

[11] Patent Number: 6,116,661

[45] Date of Patent: Sep. 12, 2000

[54] ELECTRIC DOGGING MECHANISM FOR USE WITH AN EXIT DEVICE

[75] Inventors: James Wiley Overbey, Jeffersonville, Ind.; Kun Hong Kim, Louisville, Ky.

[73] Assignee: Monarch Hardware and Manufacturing Company, Shephardsville, Ky.

[21] Appl. No.: 09/240,907

[22] Filed: Jan. 29, 1999

[51] Int. Cl.[7] ..... E05B 65/10

[52] U.S. Cl. ..... 292/92; 292/DIG. 60; 292/251.5

[58] Field of Search ..... 292/92, DIG. 60, 292/DIG. 65, 251.5, 144, 223; 70/92, 277

[56] References Cited

U.S. PATENT DOCUMENTS

| | | | |
|---|---|---|---|
| 3,854,763 | 12/1974 | Zawadzki et al. | 292/201 |
| 4,506,407 | 3/1985 | Downey | 16/48.5 |
| 4,609,910 | 9/1986 | Geringer et al. | 340/545 |
| 4,703,962 | 11/1987 | Kelly et al. | 292/251.5 |
| 4,763,937 | 8/1988 | Sittnick, Jr. et al. | 292/251.5 |
| 4,801,163 | 1/1989 | Miller | 292/92 |
| 4,839,988 | 6/1989 | Betts et al. | 49/141 |
| 4,875,722 | 10/1989 | Miller et al. | 292/92 |
| 4,906,034 | 3/1990 | Verslycken | 292/92 |
| 5,011,199 | 4/1991 | Lowe et al. | 292/92 |
| 5,042,851 | 8/1991 | Hunt | 292/21 |
| 5,072,973 | 12/1991 | Gudgel et al. | 292/55 |
| 5,085,475 | 2/1992 | Austin et al. | 292/92 |
| 5,100,186 | 3/1992 | Nordvall | 292/341.16 |
| 5,372,394 | 12/1994 | Salter et al. | 292/92 |
| 5,884,515 | 3/1999 | Milman | 70/472 |
| 5,901,992 | 5/1999 | Winkler | 292/270 |

*Primary Examiner*—Lynne H. Browne
*Assistant Examiner*—John B. Walsh
*Attorney, Agent, or Firm*—Michael H. Minns

[57] ABSTRACT

An electric dogging mechanism for an exit device consisting of slidable plate and armature which are attracted to an electric coil when the coil is energized. The slidable plate is connected to a touch bar mechanism. After the touch bar is depressed, retracting the exit device latch, the coil is energized attracting and holding the armature to the coil, thereby holding the touch bar depressed and the latch retracted by the connection of the slidable plate to the touch bar mechanism.

10 Claims, 3 Drawing Sheets

ELECTRIC DOGGING MECHANISM FOR USE WITH AN EXIT DEVICE

BACKGROUND OF THE INVENTION

This invention relates generally to dogging mechanism for use with exit devices and more particularly to an electric dogging mechanism which can be used with a fire rated exit device.

When exit devices are used in an environment where noise is obtrusive, such as churches, libraries, movie theatres, conference rooms, etc., it is desirable to dog the exit device to hold the latch in a retracted position and preferably, also hold the touch bar in a depressed position. If the exit device must also be a fire rated device, then the typical prior art mechanical dogging can not be used, since the exit device must latch closed in a fire situation.

The foregoing illustrates limitations known to exist in present fire rated exit devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an electric dogging mechanism for use with an exit device having a latch operably connected to a touch bar mechanism, the electric dogging mechanism comprising: a moveable slide plate adapted to be connected to a touch bar mechanism, the slide plate being moveable between a first position when the touch bar mechanism is in an extended position and the latch is in an extended position and a second position when the touch bar mechanism is in a depressed position and the latch is in a retracted position; and a holding means for holding the slide plate in the second position, thereby holding the touch bar mechanism in the depressed position and the latch in the retracted position, the holding means comprising: an armature operably connected to the slide plate; and a magnetic coil means for holding the slide plate in the second position.

The foregoing and other aspects will become apparent from the following detailed description of the invention when considered in conjunction with the accompanying drawing figures.

BRIEF DESCRIPTION OF THE DRAWING FIGURES

FIG. 3 is a side view of one type of prior art exit device with which the electric dogging mechanism may be used with.

DETAILED DESCRIPTION

Figure 1:
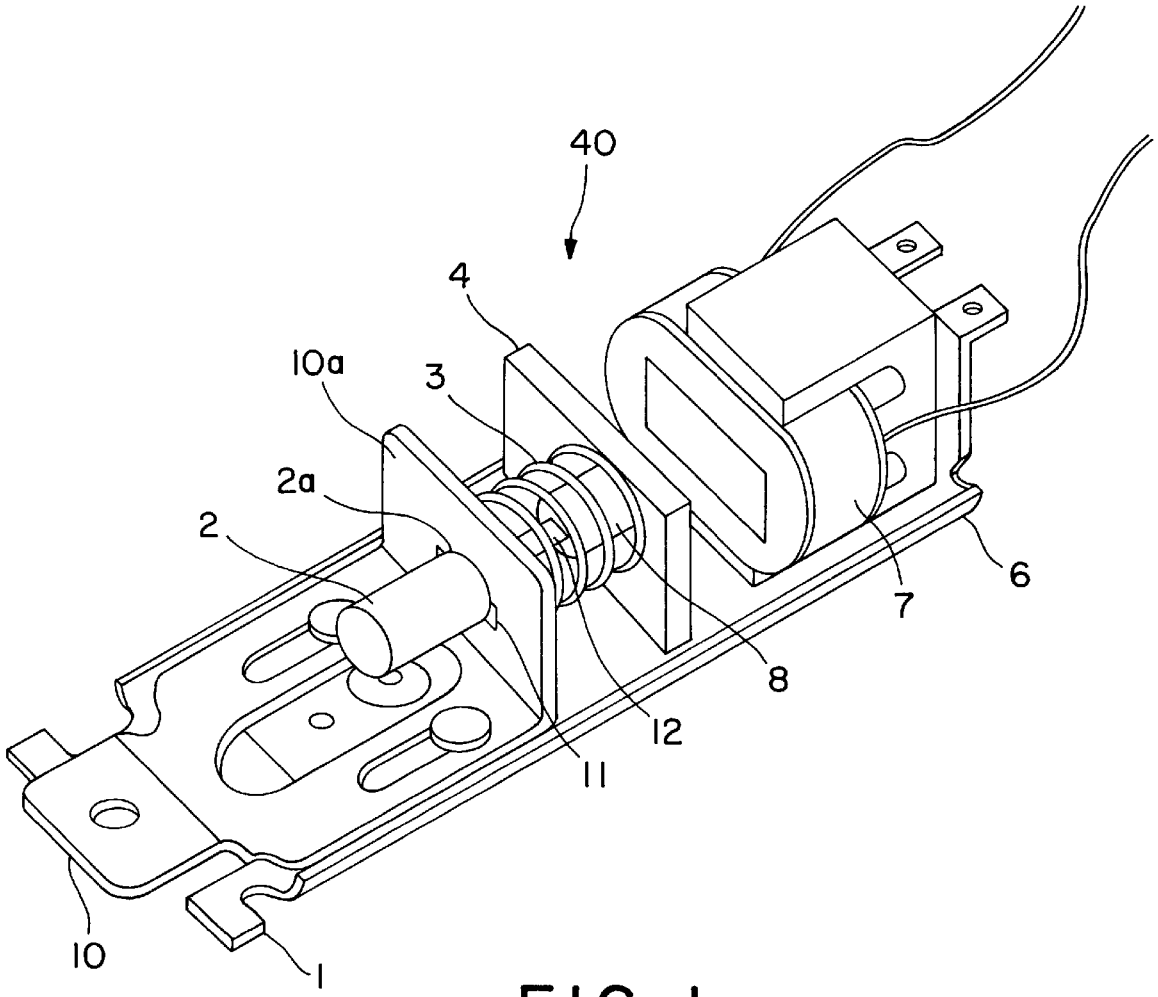
FIG. 1 is a perspective view of an electric dogging mechanism for use with an exit device.
Figure 2:
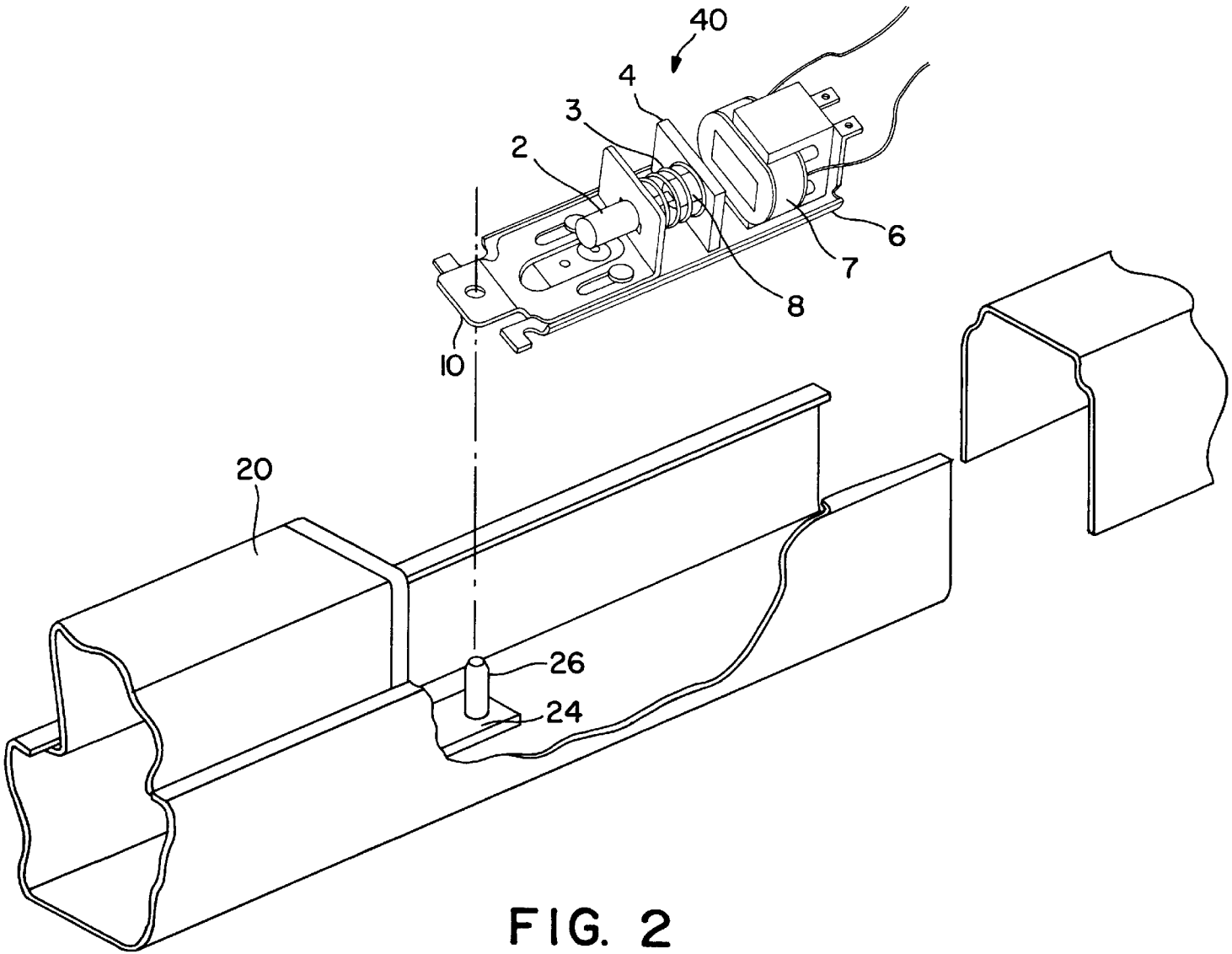
FIG. 2 is an exploded perspective view of the electric dogging mechanism shown in FIG. 1 illustrating the connection between the mechanism and the exit device.
Figure 3:
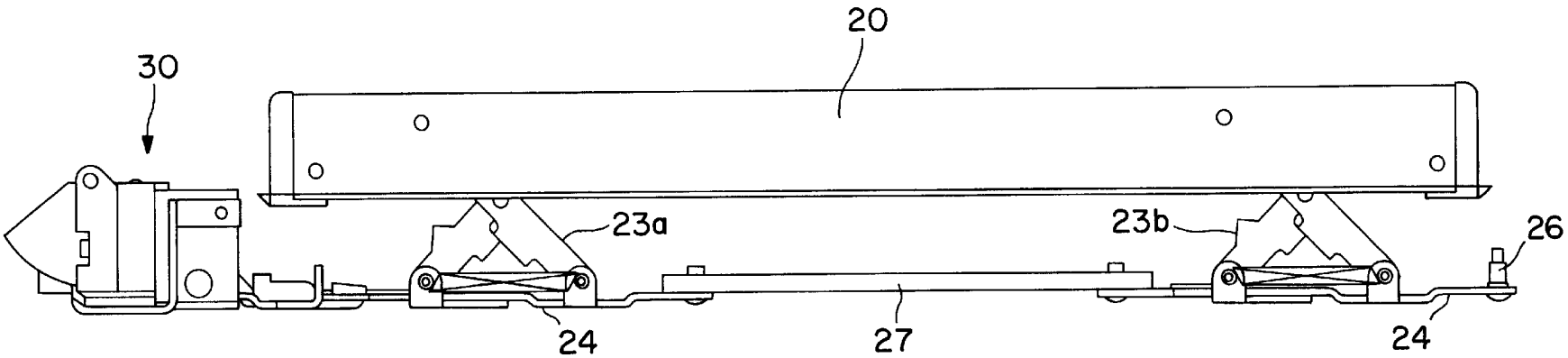
FIG. 3 PRIOR ART

FIG. 3 illustrates one type of typical prior art exit device. This exit device uses a scissors type touch bar assembly. Other typical touch bar mechanisms are shown in U.S. Pat. Nos. 4,167,280 and 5,823,582. The exit device includes a touch bar 20 connected to a pair of scissors assemblies 23*a*, 23*b* which are interconnected by a linkage connector bar 27. One scissors assembly 23*a* is connected to a latch 30. The other scissors assembly 23*b* is connected to an electric dogging mechanism 40 (shown in FIGS. 1 and 2) by a pin 26 attached to a scissors assembly base plate 24. When the touch bar 20 is depressed, the downward movement of the touch bar 20 is translated into a transverse movement of the scissors base plates 24. This transverse movement of the front scissors base plate 24, through its connection to the latch 30, causes the latch 30 to retract.

The major features of the electric dogging mechanism 40 are a magnetic coil 7 with a moveable armature 4 to hold the touch bar 20 depressed and a one step, self locking adjustment feature to account for the variations in the touch bar 20 travel for the different types and manufacturers of exit devices. A major benefit of the electric dogging mechanism 40 is the ability to be retrofit into an existing exit device.

The electric dogging mechanism 40 includes an electric coil 7 attached to a base plate 6. A dogging slide plate 10 is slidably attached to the base plate 6. One end of the slide plate 10 is connected by pin 26 to the rear scissors assembly 23*b*. Attached to an upturned portion 10*a* of the slide plate 10 is the armature 4.

To dog or hold the touch bar 20 depressed and the latch 30 retracted, the touch bar 20 is first depressed, thereby retracting the latch 30, then the electric coil 7 is energized, attracting the armature 4 to the electric coil 7 by the magnetic field created while the electric coil 7 is energized. The slide plate 10 moves because of the connection to the armature 4, thereby holding the touch bar 20 in a depressed position and the latch 30 in a retracted position.

When the power to the electric coil 7 is turned off, the magnetic field collapses, the armature 4 is released, and springs in the scissors assemblies 23*a*, 23*b* return the latch bar 20 to the extended position, thereby returning the latch 30 to the extended position.

An adjustment feature is included with the electric dogging mechanism 40. The adjustment feature includes an adjustment screw 2, consisting of a head end 2*a* and a threaded portion 12, threadedly engaging a post 8 extending from the armature 4. The adjustment screw 2 extends through an aperture 11 in the upturned portion 10*a*. This adjustment feature permits the gap between the electric coil 7 and the armature 4 to be adjusted when the touch bar 30 is fully depressed to maximize the holding force of the magnetic field by minimizing the gap between the electric coil 7 and the armature 4. The aperture 11 has a predetermined shape, shown in the Figures is a rectangular shape. The end of the head end 2*a* of the adjustment screw 2 has a complementary shape whereby, when the head end 2*a* engages the aperture 11, the complementary shapes lock the adjustment screw 2 relative to the upturned portion 10*a* to prevent rotation of the adjustment screw 2. An adjustment spring 3 is provided about the post 8 and the adjustment screw 2 to bias the armature 4 away from the upturned portion 10*a*. Compressing the adjustment spring 3 permits the locking complementary shape of the head end 2*a* to be moved out of locking engagement with the aperture 11 allowing turning movement of the adjustment screw 2.

Having described the invention, what is claimed is:

1. An electric dogging mechanism for use with an exit device having a latch operably connected to a touch bar mechanism, the electric dogging mechanism comprising:

a base elate;

a moveable slide plate adapted to be connected to a touch bar mechanism, the slide plate being slidably attached to the base plate, the slide plate being moveable between a first position when the touch bar mechanism is in an extended position and the latch is in an extended position and a second position when the touch bar mechanism is in a depressed position and the latch is in a retracted position; and a holding means for holding the slide plate in the second position, thereby holding the touch bar mechanism in the depressed position and the latch in the retracted position, the holding means being attached to the base plate, the holding means comprising: a flat plate armature operably connected to the slide plate; and a magnetic coil means for holding the slide plate in the second position, the flat plate armature being distal from the magnetic coil means when the slide plate is in the first position.

2. An electric dogging mechanism for use with an exit device having a latch operably connected to a touch bar mechanism, the electric dogging mechanism comprising:

a moveable slide plate adapted to be connected to a touch bar mechanism, the slide plate being moveable between a first position when the touch bar mechanism is in an extended position and the latch is in an extended position and a second position when the touch bar mechanism is in a depressed position and the latch is in a retracted position;

a holding means for holding the slide plate in the second position, thereby holding the touch bar mechanism in the depressed position and the latch in the retracted position, the holding means comprising a flat plate armature operably connected to the slide plate; and a magnetic coil means for holding the slide plate in the second position, the flat plate armature being distal from the magnetic coil means when the slide plate is in the first position; and an adjustment means for adjusting the position of the armature relative to the slide plate.

3. The electric dogging mechanism according to claim 2, wherein the adjustment means comprises: an adjustment screw adjustably connecting the armature to the slide plate.

4. The electric dogging mechanism according to claim 3, wherein the adjustment means further comprises: a spring biasing the armature away from the slide plate.

5. The electric dogging mechanism according to claim 3, wherein the slide plate includes a support portion having an aperture therein, the adjustment screw being inserted through the aperture.

6. The electric dogging mechanism according to claim 5, wherein the aperture has a predefined shape and the adjustment screw has a head portion having a corresponding shape whereby rotation of the adjustment screw relative to the support portion is prevented by the engagement of the adjustment screw in the aperture.

7. The electric dogging mechanism according to claim 2, wherein the adjustment means comprises the slide plate having an upturned portion; an aperture in the upturned portion, the aperture having a predefined shape; a post extending from the armature; an adjustment screw with head thereon threadedly engaging the post, the head having a corresponding shape to the aperture predefined shape for non-rotatingly engaging the aperture; and a spring about the post.

8. In combination:

an exit device having a latch moveable between an extended position and a retracted position; and a touch bar mechanism moveable between an extended position and a depressed position, the touch bar mechanism being operably connected to the latch, whereby when the touch bar mechanism is moved from the extended position to the depressed position, the latch is moved from the extended position to the retracted position; and an electric dogging mechanism comprising: a moveable slide plate moveable between a first position and a second position, the slide plate being operably connected to the touch bar mechanism, whereby when the touch bar mechanism is in the extended position, the slide plate is in the first position and when the touch bar mechanism is in the depressed position, the slide plate is in the second position; and a holding means for holding the slide plate in the second position, thereby holding the touch bar mechanism in the depressed position and the latch in the retracted position, the holding means comprising: a flat plate armature operably connected to the slide plate; and a magnetic coil means for holding the slide plate in the second position, the flat plate armature being distal from the magnetic coil when the slide plate is in the first position.

9. The combination according to claim 8, further comprising:

an adjustment means for adjusting the position of the armature relative to the slide plate.

10. An electric dogging mechanism for use with an exit device having a latch operably connected to a touch bar mechanism, the electric dogging mechanism comprising:

a moveable slide plate adapted to be connected to a touch bar mechanism, the slide plate being moveable between a first position when the touch bar mechanism is in an extended position and the latch is in an extended position and a second position when the touch bar mechanism is in a depressed position and the latch is in a retracted position; and a holding means for holding the slide plate in the second position, thereby holding the touch bar mechanism in the depressed position and the latch in the retracted position, the holding means comprising: an armature operably connected to the slide plate; a magnetic coil means for holding the slide plate in the second position; and an adjustment means for adjusting the position of the armature relative to the slide plate, the adjustment means comprising the slide plate having an upturned portion, an aperture in the upturned portion; the aperture having a predefined shape; a post extending from the armature; an adjustment screw with head thereon threadedly engaging the post, the head having a corresponding shape to the aperture predefined shape for non-rotatingly engaging the aperture; and a spring about the post.

* * * * *